United States Patent [19]

Kurihara et al.

[11] Patent Number: 4,519,093

[45] Date of Patent: May 21, 1985

[54] ROTARY ANODE X-RAY TUBE

[75] Inventors: Teruo Kurihara; Takeshi Oowa, both of Yokohama, Japan

[73] Assignee: Tokyo Shibaura Denki Kabushiki Kaisha, Kawasaki, Japan

[21] Appl. No.: 580,298

[22] Filed: Feb. 21, 1984

Related U.S. Application Data

[63] Continuation of Ser. No. 290,306, Aug. 5, 1981.

[30] Foreign Application Priority Data

Aug. 19, 1980 [JP] Japan ..... 55-113031

[51] Int. Cl.[3] ..... H01J 35/04

[52] U.S. Cl. ..... 378/132; 378/125

[58] Field of Search ..... 378/132, 133, 125

[56] References Cited

U.S. PATENT DOCUMENTS

| | | | |
|---|---|---|---|
| 3,634,870 | 1/1972 | Kessler et al. | 378/132 |
| 3,694,685 | 9/1972 | Houston | 378/130 |
| 3,720,853 | 3/1973 | Atlee et al. | 378/132 |
| 4,272,696 | 6/1981 | Stroble | 378/132 |

FOREIGN PATENT DOCUMENTS 203874 10/1954 Australia .

*Primary Examiner*—Craig E. Church

*Attorney, Agent, or Firm*—Oblon, Fisher, Spivak, McClelland & Maier

[57] ABSTRACT

A rotary anode X-ray tube comprises a support frame disposed inside a glass bulb, a rotary anode fixed to a shaft portion of the support frame, a rotating shaft attached to the support frame coaxially with the shaft portion, a support member having a cylindrical portion concentrically surrounding the rotating shaft at a given space therefrom, a double tube concentrically disposed between the rotating shaft and the cylindrical portion and fixed to the cylindrical portion, first and second bearings concentrically disposed between the auxiliary tube and the rotating shaft at given spaces therefrom, and a coil spring for elastically pressing one race of one of the bearings along said rotating shaft, the other race of which is fixed.

7 Claims, 7 Drawing Figures

ROTARY ANODE X-RAY TUBE

This application is a continuation of application Ser. No. 290,306, filed Aug. 5, 1981.

BACKGROUND OF THE INVENTION

This invention relates to a rotary anode X-ray tube provided with a pair of bearings rotatably supporting a rotary anode portion.

Generally, in rotary anode X-ray tubes of this type, the rotary anode portion is rotated at such a high speed as e.g. 9,000 rpm in a high-vacuum atmosphere. As for the bearings rotatably supporting the rotary anode portion, they are heated to such a high temperature as approximately 450° C. because heat produced by the rotary anode emitting X-rays is transmitted thereto through a rotating shaft. Therefore, the bearings will more severely be worn away, damaged, or displaced as compared with other members, and it is generally said that the life of the rotary anode X-ray tube depends upon the life performance of the bearings.

Accordingly, in one such prior art rotary anode X-ray tube, the bearings are incorporated therein by fixing with high accuracy their inner and outer races to the outer peripheral surface of the rotating shaft of the rotary anode portion and the inner peripheral surface of an anode support, respectively. Since the bearings are used under circumstances of high vacuum and high temperature, as aforesaid, they cannot be of the commonly used oil-lubricating type. Therefore, the bearings used are of a solid-lubricating type in which the inner and outer races and rolling bodies are plated or coated by chemical vapor deposition with gold, silver, lead or other material. As compared with oil-lubricating bearings, however, the solid-lubricating bearings are subject to increased play or reciprocal eccentricity depending upon the manner of assembly and/or use, in spite of high-accuracy assembly. Accordingly, there will be caused substantial vibration and noise in and around the bearings, and such vibration and noise will be increased quickly, thus deteriorating the life performance of the bearings and hence of the rotary anode X-ray tube.

SUMMARY OF THE INVENTION

The object of this invention is to provide a rotary anode X-ray tube capable of limiting at assembly the play of bearings and eccentricity between the bearings, and of satisfactorily maintaining such play and eccentricity after prolonged use, thus enjoying improved life performance.

In a rotary anode X-ray tube according to this invention, an auxiliary tube is concentrically disposed between the inner circumferential surface of a cylindrical portion of a support member and the outer peripheral surface of a rotary anode portion. The inner or outer race of one of a pair of bearings is elastically urged in one direction to slide along a rotating shaft by an urging means attached to the auxiliary tube, and the remaining race is fixed.

Thus, even if the reciprocal concentricity of the bearings tends to become somewhat inaccurate at assembly of the X-ray tube, one race will be shifted by the urging means to correct the eccentricity and to ensure high concentricity. Lack of concentricity between the bearings due to thermal expansion of the rotating shaft during use will be able to be corrected in like manner.

BRIEF DESCRIPTION OF THE DRAWINGS

FIGS. 4A to 4C are diagrams showing results of a test on the noise characteristics of the rotary anode X-ray tube according to the invention and a prior art rotary anode X-ray tube, in which FIG. 4A shows a spectrum of the prior art X-ray tube, FIG. 4B shows a spectrum of the X-ray tube of the invention, and FIG. 4C shows a spectrum representing the difference between the spectra of the prior art X-ray tube and the X-ray tube of the invention.

DETAILED DESCRIPTION OF THE PREFERRED EMBODIMENTS

Now there will be described a rotary anode X-ray tube according to an embodiment of this invention with reference to the accompanying drawings.

Figure 1:
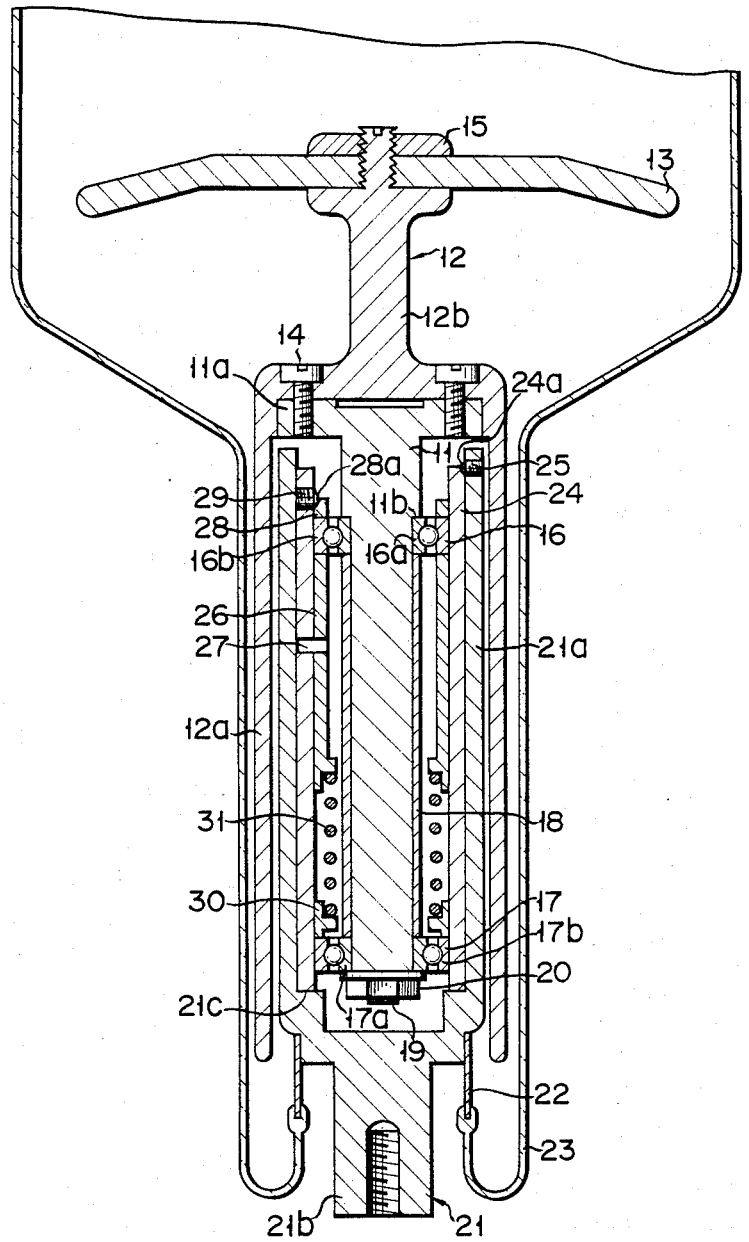
FIG. 1 is a sectional view of a rotary anode X-ray tube according to an embodiment of this invention.

In FIG. 1, numeral 11 designates a cylindrical rotating shaft, and a support frame 12 is coaxialy fixed by means of screws 14 to a thickened portion 11*a* formed on one end of the rotating shaft 11. The support frame 12, which surrounds the rotating shaft 11 at a given space therefrom, is composed of a cylindrical portion 12*a* with one end closed and the other opened, and a shaft portion 12*b* protruding outward from the center of the closed end of the cylindrical portion 12*a*. A conventional rotary anode 13 is fixed tight to the extended end of the shaft portion 12*b* by means of a nut 15. Electrons emitted from a cathode (not shown) come into collision with the surface of the rotary anode 13 to produce X-rays.

A stepped portion 11*b* is formed on the rotating shaft 11 in the vicinity of the thickened portion 11*a*. An inner race 16*a* of a first bearing 16 surrounding the rotating shaft 11 is held between the stepped portion 11*b* and one end of a metal spacer 18 which is formed of a cylindrical body having an inner circumferential surface closely in contact with the outer circumferential surface of the rotating shaft 11 and opened at both ends. Between the other end of the spacer 18 and a nut 20 screwed on a threaded portion 19 formed on the other end of the rotating shaft 11, there is an inner race 17*a* of a second bearing 17 which is held by tightening the nut 20.

In FIG. 1, numeral 21 designates a support member which is composed of a cylindrical body 21*a* inserted in a gap between the rotating shaft 11 and the cylindrical portion 12*a* of the support frame 12 and having one end opened and the other closed, and a shaft portion 21*b* extending outward from the closed end of the cylindrical body 21*a* and attached to a support structure (not shown). The outer periphery of the closed portion of the support member 21 is fitted with one end of a seal ring 22 the other end of which is fitted by deposition with one end of a glass bulb 23 hermetically enclosing the rotatry anode and cathode. A stepped portion 21*c* is formed on the inner circumferential surface of the cylindrical body 21*a* of the support member 21 in the vicinity of the closed end of the cylindrical body 21*a*. On the stepped portion 21*c* abuts one end of an intermediate fixed tube 24 of metal such as stainless steel having both ends opened. The intermediate fixed tube 24 is disposed concentrically with the rotating shaft 11, having its outer circumferential surface entirely or partially in contact with the inner circumferential surface of the cylindrical body 21. A taper surface 24*a* is formed on the outer circumferential surface of the other end of the fixed tube 24, and the tip end of a setscrew 25 screwed in from the outer surface side of the cylindrical body 21*a* is pressed against the taper surface 24*a*. Thus, by the press of the tip end of the setscrew 25 on the taper surface 24*a*, the fixed tube 24 is pressed against the stepped portion 21*c* of the cylindrical body 21*a*, and held and fixedly maintained by the setscrew 25 and the stepped portion 21*c*. Inside the fixed tube 24, there is disposed a pressing tube 26 of metal such as stainless steel so that the outer circumferential surface of the pressing tube 26 is in contact with the inner circumferential surface of the fixed tube 24. The pressing tube 26 is fixed by means of a retaining pin 27 inserted from the outer surface side of the fixed tube 24 so that one end thereof is in contact with one end of an outer race 16*b* of the first bearing 16. The other end of the outer race 16*b* abuts on one end of a pressing ring 28 which is concentrically disposed in the fixed tube 24. Formed on the other end of the ring 28 is a taper surface 28*a* on which the tip end of a setcrew 29 screwed in from the outer surface side of the fixed tube 24 abuts. Thus, the ring 28 is pressed toward the bearing 16 so that the bearing 16 is held between the ring 28 and the one end of the pressing tube 26.

A ring-shaped spring bearing 30 abuts on one end of an outer race 17*b* of the second bearing 17 facing the pressing tube 26, and a coil spring or compression spring 31 is interposed between the spring bearing 30 and the other end of the pressing tube 26. On the other end side of the outer race 17*b* of the second bearing 17, there is provided no means for restricting the movement of the outer race 17*b*, so that the outer race 17*b* can slide on the inner circumferential surface of the fixed tube 24 along the axis thereof. Thus, the outer race 17*b* is always elastically pressed by the compression spring 31 through the spring bearing 30 in one direction to be separated from the first bearing 16. The spring 31 is formed of heat resisting material, such as e.g. Inconel (trademark), an alloy of nickel containing chromium and iron. The preload applied to the outer bearing race 17*b* by the spring 31 is 6 kg·f in this embodiment.

In the rotary anode X-ray tube of the above-mentioned construction, the outer race 17*b* of the second bearing 17 is elastically urged in one direction by the spring 31, so that there will be caused at assembly no axial or radial backlash between the inner and outer races and rollers of the bearings 16 and 17. Even if the rotating shaft 11 is expanded by intense heat generated at the rotary anode 13 during use, the displacement of the inner races due to such expansion may be compensated by the displacement of the outer races caused by the spring, so that the bearings will suffer no backlash or play.

In a prior art rotation anode X-ray tube, the outer races of the bearings 16 and 17 are supported directly on the inner circumferential surface of the support member 21 without using the intermediate fixed tube 24 of the aforementioned arrangement. In such construction, a hole defined by the cylindrical body 21*a* of the support member 21 is closed at one end, and hence is poorer than a through hole in working accuracy such as concentricity. Since the metal seal ring 28 is welded to the support member 21 by brazing or other method after boring work, the support member 21 is heated to a high temperature and distorted after cooling. It is therefore difficult to maintain the accuracy of the circular hole. In the rotation anode X-ray tube of this embodiment having the aforementioned construction, however, the intermediate fixed tube 24 having a through hole with a uniform diameter is disposed between the support member 21 and the bearings 16 and 17 so that the outer circumferential surface of the fixed tube 24 is supported by the support member 21 and that the bearings 16 and 17 are sustained by the inner circumferential surface of the fixed tube 24. Having the through hole, the intermediate fixed tube 24 is improved in working accuracy. Moreover, since the seal ring 28 is not welded, there will be no possibility of thermal distortion of the fixed tube 24. Accordingly, the bearings 16 and 17 are greatly improved in concentricity and hence in life performance as compared with their conventional counterparts.

Figure 2:
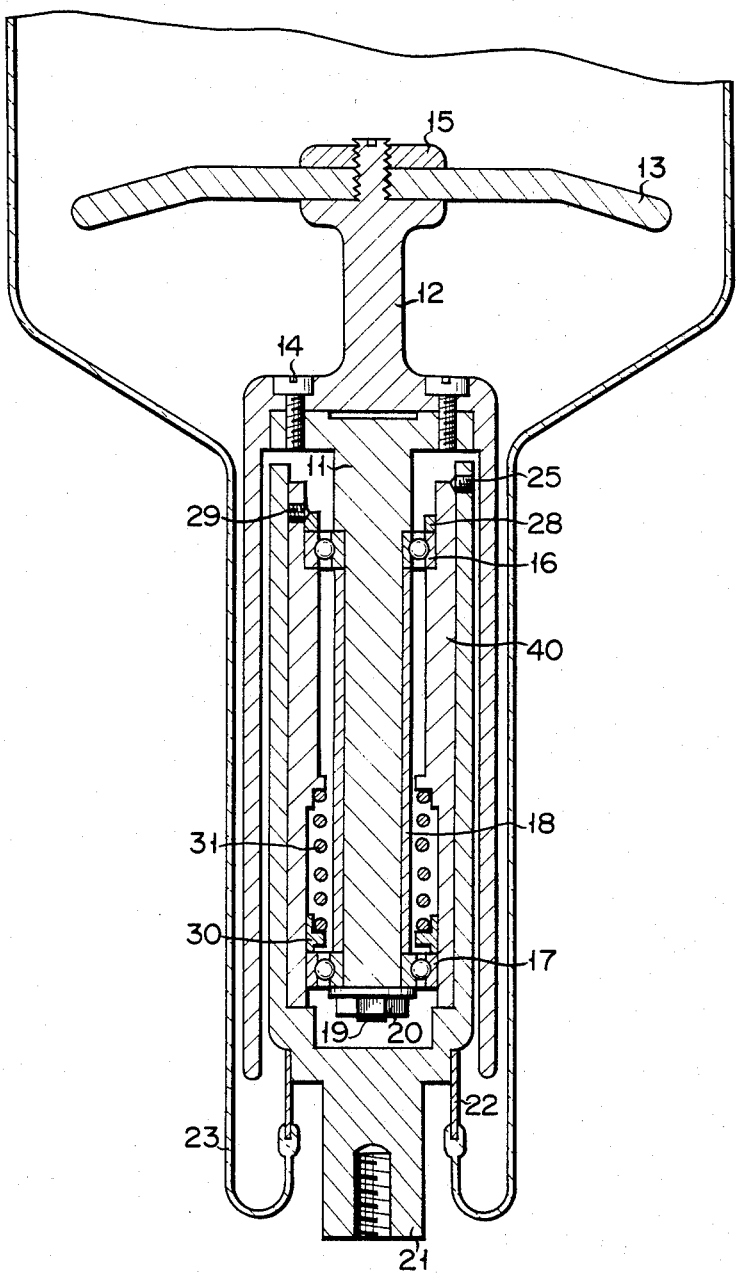
FIG. 2 is a sectional view of a rotary anode X-ray tube according to another embodiment of the invention.

Referring now to FIG. 2, there will be described a rotary anode X-ray tube according to another embodiment of the invention.

In FIGS. 1 and 2, like reference numerals are used to designate like portions without repeating the detailed description thereof.

The embodiment of FIG. 2 is identical with the foregoing embodiment, except that an auxiliary member or assembly including the intermediate fixed tube 24 and the pressing tube 26 shown in FIG. 1 is composed of an auxiliary tube 40 of metal such as stainless steel into which those two tubes of FIG. 1 are integrated. Therefore, the outer race of the first bearing 16 is held between one end of the auxiliary tube 40 and the pressing ring 28, and one end of the coil spring 31 is sustained by the other end of the auxiliary tube 40. The use of such auxiliary tube 40 makes the diameter of the portion supporting the first and second bearings 16 and 17 uniform, like that of the counterpart in the foregoing embodiment, reducing the number of components used as well as the number of assembling processes.

Figure 3:
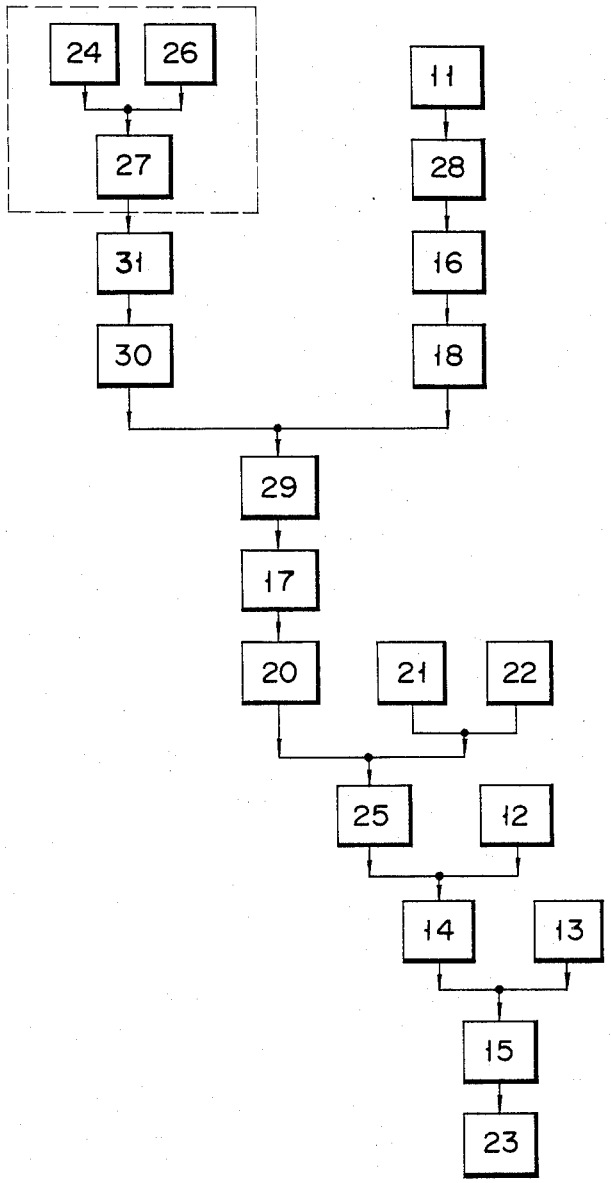
FIG. 3 is a block diagram showing processes for assembling the rotary anode X-ray tube.

Referring now to FIG. 3, there will be described the method of assembling the rotary anode X-ray tube of FIG. 1 in order of process.

In FIG. 3, numerals in several blocks correspond to the reference numerals of FIG. 1.

First, the pressing ring 28 and the first bearing 16 are successively put on the rotating shaft 11, and then the spacer 18 is fitted on the rotating shaft 11 to fix the first bearing 16 to the rotating shaft 11. Apart from this process, the pressing tube 26 is inserted in the intermediate fixed tube 24, and these tubes are fixed to each other by means of the pin 27 (this process is omitted for the X-ray tube of FIG. 2). Subsequently, the coil spring 31 and the spring bearing 30 are successively inserted into the intermediate fixed tube 24. The rotating shaft 11 is inserted into thus constructed double tube consisting of the fixed tube 24 and the pressing tube 26 through one end opening thereof with the end portion of the rotating shaft 11 on the opposite side to the rotary anode forward. Then, the screw 29 is screwed into a tapped hole formed in the intermediate fixed tube 24 so that the pressing ring 28 is fixed between the projected end of the screw 29 and the one end of the outer race 16*b* of the first bearing 16. Further, the second bearing 17 is inserted into the double tube from the end portion of the rotating shaft 11 on the opposite side to the rotary anode so that the rotating shaft 11 is surrounded by the second bearing 17, and the nut 20 is fitted on the threaded portion formed at the end portion of the rotating shaft 11 and tightened. Thus completed is an integral component consisting of the rotating shaft 11, spacer 18, first and second bearings 16 and 17, spring 31, spring bearing 30, pressing tube 26, pressing ring 28, and intermediate fixed tube 24.

Subsequently, the seal ring 22 is fixed to the support member 21 by brazing. Then, the intermediate fixed tube 24 assembled in the aforesaid process is inserted into the cylindrical portion 21*a* of the support member 21, and the setscrew 25 is fitted in a tapped hole formed in the vicinity of the open end of the cylindrical portion 21*a* of the support member 21 so that the tip end of the setscrew 25 abuts on the taper portion 24*a* formed on the upper end of the intermediate fixed tube 24 to fix the tube 24. Thereafter, the cylindrical portion 12*a* of the support frame 12 is put on the rotating shaft 11 from the one end side thereof, that is, from the side on which the first bearing 16 is disposed, and is coaxially fixed to the rotating shaft 11 by means of the screws 14. Then, the rotary anode 13 is fixed to the top end of the shaft portion 12*b* of the support frame 12 by tightening the nut 15. Finally, the assembly constructed in this manner is sealed by means of the glass bulb 23.

Now there will be described results of comparative measurements of noise and life characteristics of the rotary anode X-ray tube according to this invention and the prior art rotary anode X-ray tube.

In these comparative measurements, the X-ray tube shown in FIG. 2 was used for the X-ray tube according to the invention, and the X-ray tube of the aforementioned type was given as the prior art example.

Figure 4A:
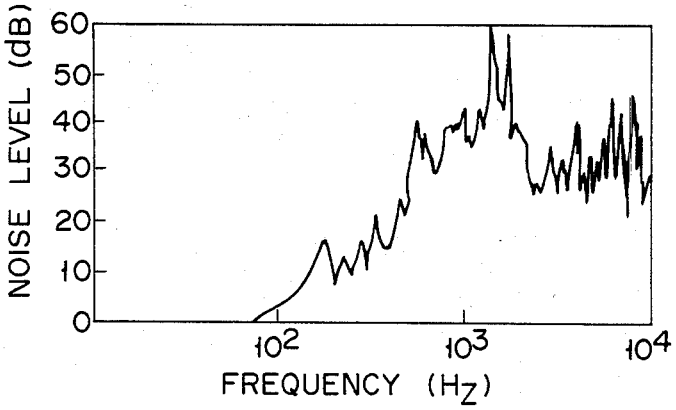
Figure 4B:
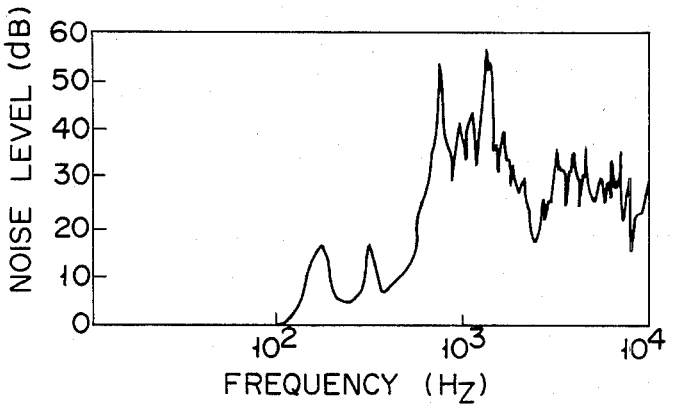
Figure 4C:
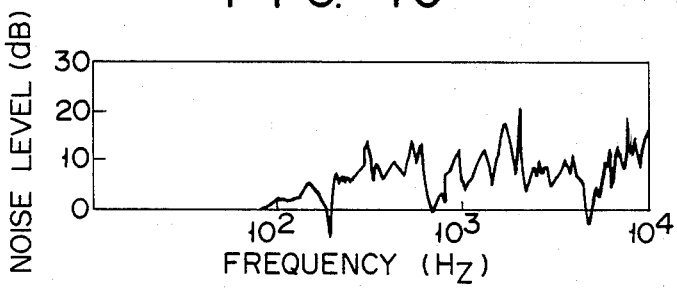

As may be seen from noise spectra based on frequency of FIGS. 4A and 4B, the noise characteristic of the prior art X-ray tube shown in FIG. 4A is given by a continuous spectrum within a range from 800 to 1,200 Hz, exhibiting great amplitude and high noise level in a low-frequency range. With the characteristic curve of the invention shown in FIG. 4B, on the other hand, the vibration spectrum is discrete, and the noise level is approximately 10 dB lower than that of the prior art X-ray tube substantially at every frequency. To clarify such difference, FIG. 4C shows a spectrum representing the difference in noise level between the prior art X-ray tube and the X-ray tube of the invention.

Figure 5:
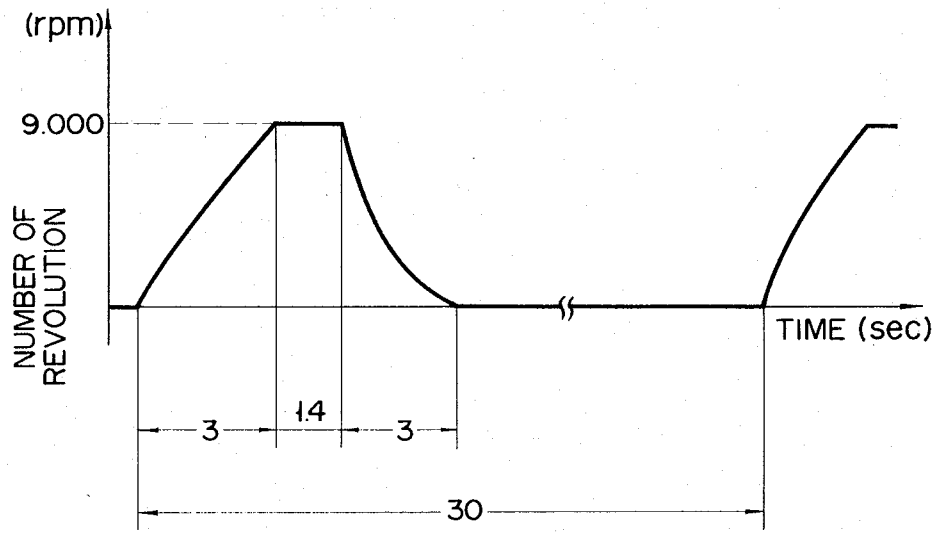
FIG. 5 is a diagram for illustrating a life performance test on the rotary anode X-ray tube of the invention.

A life performance test was conducted under conditions ar follows; single-phase 75 kV–120 mA–1.4 s (25,000 HU/min) for anode input, driving gear RS-117 from Toko Shibaura for stator, 200 V (half-wave)–3 sec for damping characteristic of stator, and 2 exp/min for cycle per second. As shown in FIG. 5, moreover, there were used other conditions, including 9,000 rpm for the number of revolutions of anode, 3 sec for the start of each exposure, constant-speed rotation at 9,000 rpm, 1.4 sec for exposure, and 3 sec for damping.

As a result, the noise was augmented after 93,000 exposures, so that it was concluded that the life performance had been detected, and the driving of the X-ray tube was stopped. The life performance of 93,000 exposures satisfactorily fulfills the practical requirement or life performance of 50,000 exposures or more, and is much higher than that of the prior art X-ray tube.

Although the outer race of the second bearing is subjected to elastic force in the above-mentioned embodiments, the elastic force may alternatively be applied to the inner race of the second bearing or the outer or inner race of the first bearing. The elastic force may be obtained by using any other means than the coil spring, e.g., a helical spring.

In the bearings used in the X-ray tube of the invention, the inner and outer races and rolling bodies such as balls or rollers are preferably plated or coated by chemical vapor deposition with metal such as silver or lead which is less frictional, low in vapor pressure, and stable to heat. Although not limitative, angular ball bearings are preferably used for those bearings.

What we claim is:

1. A rotary anode X-ray tube comprising:

a bulb;

a support frame having a shaft portion and disposed inside said bulb;

a rotary anode fixed to the shaft portion of said support frame;

a rotating shaft attached to said support frame coaxially with said shaft portion;

a support member having a cylindrical portion concentrically surrounding said rotating shaft at a given space therefrom wherein said support member is constructed of a soft material which is subject to deformation at normal operating temperatures of said tube;

an auxiliary tube concentrically disposed between said rotating shaft and said cylindrical portion and fixed to said cylindrical portion wherein said auxiliary tube is constructed of a material which is hard relative to said material of said support member and wherein said material of said auxiliary tube is not subject to deformation at normal operating temperatures of said tube;

first and second bearings concentrically disposed between said auxiliary tube and said rotating shaft at given spaces therefrom, each said bearing having an inner race located on the rotating shaft side and an outer race located on the auxiliary tube side wherein the outer circumferential surface of said outer race of each bearing abuts on the inner circumferential surface of said auxiliary tube so that both said bearings are concentrically supported by said auxiliary tube;

an urging means for elastically pressing one race of at least one of said bearings along said rotating shaft; and a means for fixing the other race of said one bearing.

2. A rotary anode X-ray tube according to claim 1, wherein said one bearing is located farther from said rotary anode than said other bearing is.

3. A rotary anode X-ray tube according to claim 2, wherein said one race of said one bearing is an outer race slidable along the inner circumferential surface of said auxiliary tube, and said other race is an inner race fixed to the outer circumferential surface of said rotating shaft.

4. A rotary anode X-ray tube according to claim 3, wherein one race of the other bearing is an outer race fixed to said auxiliary tube, and the other race of said other bearing is an inner race fixed to the outer circumferential surface of said rotating shaft.

5. A rotary anode X-ray tube according to claim 4, wherein said auxiliary tube includes a fixed tube fixed to the inner circumferential surface of the cylindrical portion of said support member and having a given inside diameter, and a pressing tube having an overall length shorter than that of said fixed tube and fixed to the inner circumferential surface of said fixed tube.

6. A rotary anode X-ray tube according to claim 5, wherein said urging means includes a compression spring disposed between one end of said pressing tube and the outer race of said one bearing and elastically pressing said outer race in a direction to separate said outer race from said rotary anode.

7. A rotary anode X-ray tube according to claim 4, wherein said auxiliary tube has a stepped portion, and said urging means includes a compression spring disposed between said stepped portion and the outer race of said one bearing and elastically pressing said outer race in a direction to separate said outer race from said rotary anode.

* * * * *